US009371642B2

(12) United States Patent
Herbertsson et al.

(10) Patent No.: US 9,371,642 B2
(45) Date of Patent: Jun. 21, 2016

(54) ATTACHMENT OF WALL ELEMENTS

(71) Applicant: Troax AB, Hillerstorp (SE)

(72) Inventors: Ronny Herbertsson, Hillerstorp (SE); Staffan Bengtsson, Gnosjö (SE)

(73) Assignee: Troax AB, Hillerstorp (SE)

( * ) Notice: Subject to any disclaimer, the term of this patent is extended or adjusted under 35 U.S.C. 154(b) by 240 days.

(21) Appl. No.: 13/693,080

(22) Filed: Dec. 4, 2012

(65) Prior Publication Data

US 2013/0139461 A1 Jun. 6, 2013

(30) Foreign Application Priority Data

Dec. 5, 2011 (SE) ..... 1100894

(51) Int. Cl.

| | |
|---|---|
| ***B21F 27/00*** | (2006.01) |
| ***E04H 17/02*** | (2006.01) |
| ***E04B 1/38*** | (2006.01) |
| ***E04H 17/16*** | (2006.01) |
| *E04H 17/08* | (2006.01) |

(52) U.S. Cl.

CPC ..... *E04B 1/38* (2013.01); *E04H 17/163* (2013.01); *E04H 17/08* (2013.01)

(58) Field of Classification Search

CPC ..... E04B 1/38; E04B 2/7433; E04B 2/7437; E04B 2/82; E01F 15/146; E04H 17/063; E04H 17/24; E04H 17/16; E04H 17/18; E04H 17/163; E04H 2017/006; E04H 2017/1473; E04H 17/08; F16B 12/02; F16B 12/22

USPC ..... 256/24, 28–30, 65.14, 73; 430/235; 52/474

See application file for complete search history.

(56) References Cited

U.S. PATENT DOCUMENTS

| | | | | | |
|---|---|---|---|---|---|
| 3,722,928 | A | * | 3/1973 | Skubic | 52/714 |
| 3,791,096 | A | * | 2/1974 | Epperlein | 403/315 |
| 3,933,311 | A | * | 1/1976 | Lemelson | 239/276 |
| 4,137,636 | A | * | 2/1979 | Dietrich | 33/404 |
| 4,955,648 | A | * | 9/1990 | Miller | 292/258 |
| 5,372,354 | A | | 12/1994 | Cacicedo | |
| 5,430,984 | A | * | 7/1995 | Young et al. | 52/281 |
| 5,961,242 | A | | 10/1999 | Leone | |
| 6,128,876 | A | * | 10/2000 | Nitschke et al. | 52/239 |
| 6,149,135 | A | * | 11/2000 | Hlavin | 256/24 |

(Continued)

FOREIGN PATENT DOCUMENTS

| | | |
|---|---|---|
| DE | 3311088 A1 | 9/1984 |
| DE | 8515350 U1 | 7/1985 |

(Continued)

OTHER PUBLICATIONS

International Type Search Report (May 16, 2012) for corresponding Swedish Application SE 1100894-3.

(Continued)

*Primary Examiner* — Gregory Binda
*Assistant Examiner* — Nahid Amiri
(74) *Attorney, Agent, or Firm* — WRB-IP LLP

(57) ABSTRACT

In a device for attachment of a surface shaped wall element between two upright poles which have two positions for the wall element, an unstable readiness position and a locked position, at least one encircling mounting is provided on each pole for support of the wall element.

14 Claims, 8 Drawing Sheets

(56) References Cited

U.S. PATENT DOCUMENTS

| | | | | |
|---|---|---|---|---|
| 7,461,489 | B2 * | 12/2008 | Herbertsson | 52/578 |
| 7,516,946 | B2 * | 4/2009 | Fumagalli | 256/65.14 |
| 7,628,386 | B2 * | 12/2009 | Payne | 256/47 |
| 2006/0150546 | A1 | 7/2006 | Fumagalli | |
| 2008/0029748 | A1 * | 2/2008 | Ford | 256/65.03 |

FOREIGN PATENT DOCUMENTS

| | | | |
|---|---|---|---|
| DE | 299 15 580 | U1 | 1/2000 |
| DE | 202010010155 | U1 | 10/2010 |
| DE | 10 2010 021556 | A1 | 12/2011 |
| EP | 2 226 451 | A1 | 9/2010 |
| NL | 1 002 257 | C2 | 8/1997 |
| SE | 524266 | C2 | 7/2004 |

OTHER PUBLICATIONS

European Search Report (Dec. 6, 2013) for corresponding European App. EP 12 19 4026, Dec. 16, 2016.

European Search Report (Feb. 22, 2016) for corresponding European App. EP 12 19 4026.

* cited by examiner

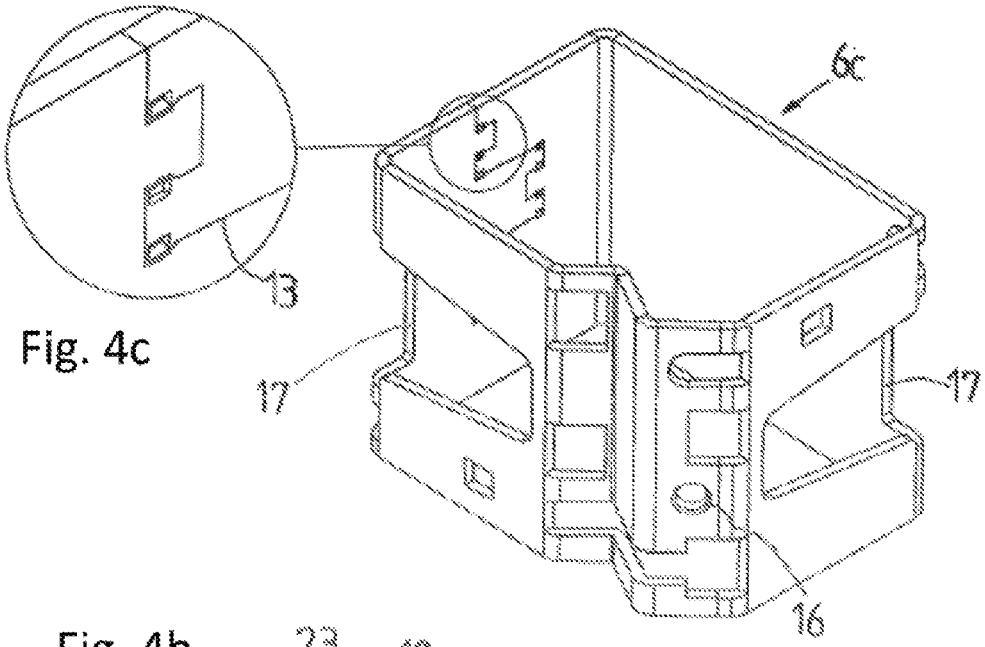
Fig. 4c
Fig. 4a
Fig. 4b
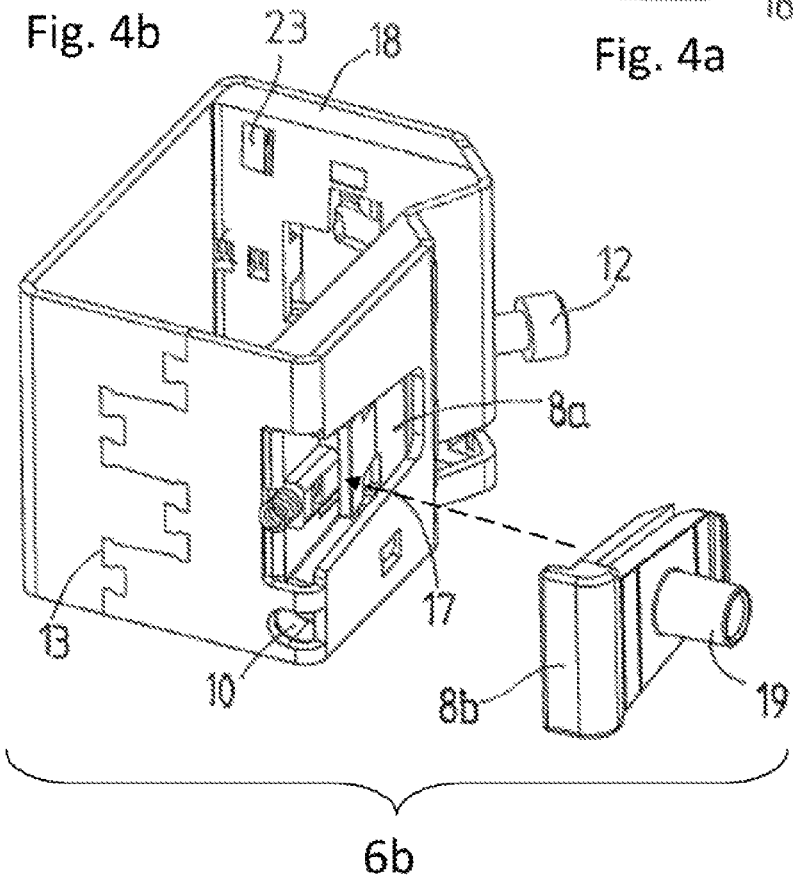

Fig. 5a
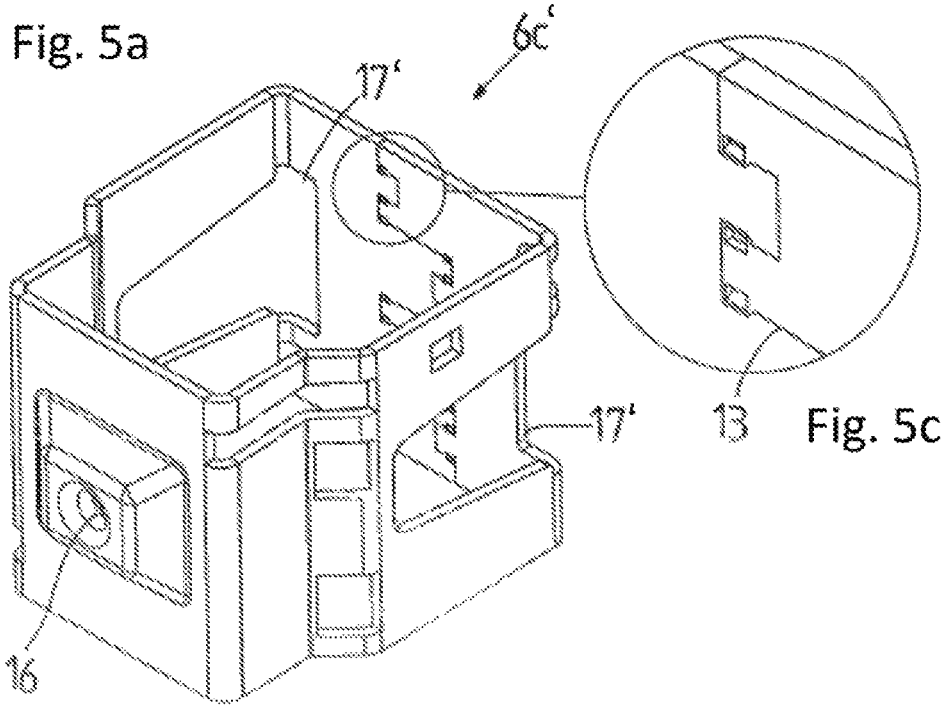
Fig. 5c
Fig. 5b
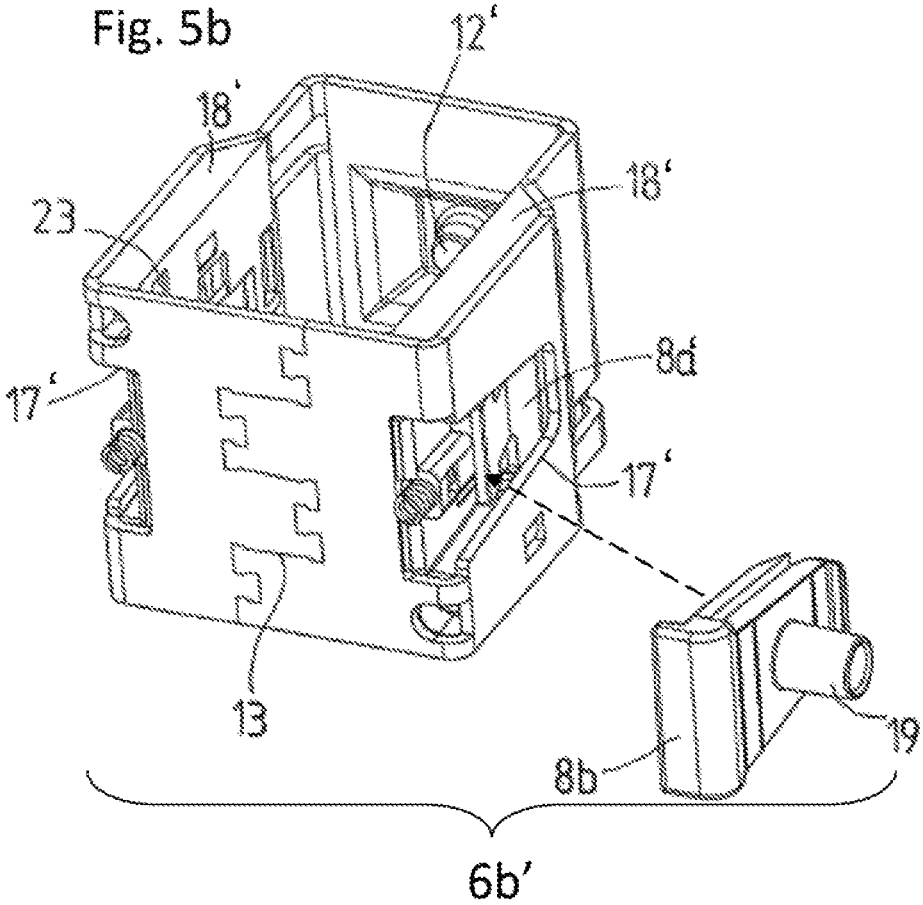

ATTACHMENT OF WALL ELEMENTS

BACKGROUND AND SUMMARY

The present invention relates to a device for attachment of a surface shaped wall element between two upright, supporting poles, wherein the wall element is arrangeable in an unstable readiness position, from where it is brought to a locked position.

In different contexts, for example within the vehicle industry there is a need to provided shielding, for example around machines. Shielding around machines, so-called machine safeguards, aim to prevent that persons by mistake get into a machine work area and thereby run the risk of getting injured, or to prevent unauthorized persons to control the machine. A machine safeguard may also be used to catch details which are machined, but which are dropped by the machine or the robot which works on the inside of the machine safeguard.

There are a lot of legal requirements which applies to such shielding and machine safeguards. One example of this is that it shall not be possible to open the machine safeguard from the outside without a key or any particular tool. It shall neither be possible to arrange parts of the machine safeguard in a mounted position without them being locked in the above described way. Thus the machine safeguard shall not be designed in such a way that it by mistake or intentionally is unlocked without this being obvious.

An example of a machine safeguard of this type is shown in SE 524 266, wherein a series of grating sections are mounted between upright standing poles of steel. At the lower end area of respective section there is protrusions which are receivable in recesses in the nearby poles. Since the protrusions are placed far below the center of gravity of the wall section, it is impossible for the wall section to take a stable equilibrium position, and it may therefore not be unlocked without being obvious. In the locked position of the section a lock device, which is arranged at the upper parts of the outer edges of the wall section, has been brought into the corresponding recesses in the poles and thereby been snapped into position, from which the lock device may not be unlocked without usage of a special tool.

The German company "RK Rose+Krieger" markets another solution according to similar principles, but wherein pins are provided in an upper respective a lower position on poles, whereas receiving means and lock means are provided at the edges of the wall elements, such that the wall elements may not be left in a mounted but unlocked, position and special tools are demanded to release the wall elements from their locked positions. The pins in this solution are provided in undercut slots on profiles of aluminium.

Both the above described solutions are like other solutions per se working as machine safeguards, but they are rather expensive, in the first case especially regarding the machining and in the second case regarding the material. At comparison of the two examples it is possible to observe that the latter solution gives a slightly higher flexibility this since the positions of protrusions is vertically adjustable along the undercut slot in the pole. Except that the material, i.e. aluminium, is more expensive, it must also be regarded as a certain drawback that the production of aluminium in itself is very energy consuming, and thereby involves an environmental impact.

It is thus desirable to achieve a flexible solution for shielding and machine safeguards and to a lower cost than what has been possible until now.

According to an aspect of the present invention, a device is provided for attachment of a all element beta un two upright, supporting poles, wherein the wall element is arrangeable in an unstable readiness position, from where it is brought into an locked position, the device comprising at least one encircling mounting is provided on each pole for support of the wall element.

BRIEF DESCRIPTION OF THE DRAWINGS

The invention is now described with reference to the accompanying drawings, in which:

FIG. 4*a* shows an isometric view of a first embodiment of a second clamp according to the invention;

FIG. 4*b* shows an isometric view of the completed clamp according to FIG. 4*a;*

FIG. 4*c* is an enlarged view of a portion of FIG. 4*a;*

FIG. 5*a* shows an isometric view of a body for a second embodiment of a second clamp according to the invention;

FIG. 5*b* shows an isometric view from the opposite direction of the completed clamp accordion to FIG. 5*a;*

FIG. 5*c* is an enlarged view of a portion of FIG. 5*a;*

DETAILED DESCRIPTION

Figure 1A:
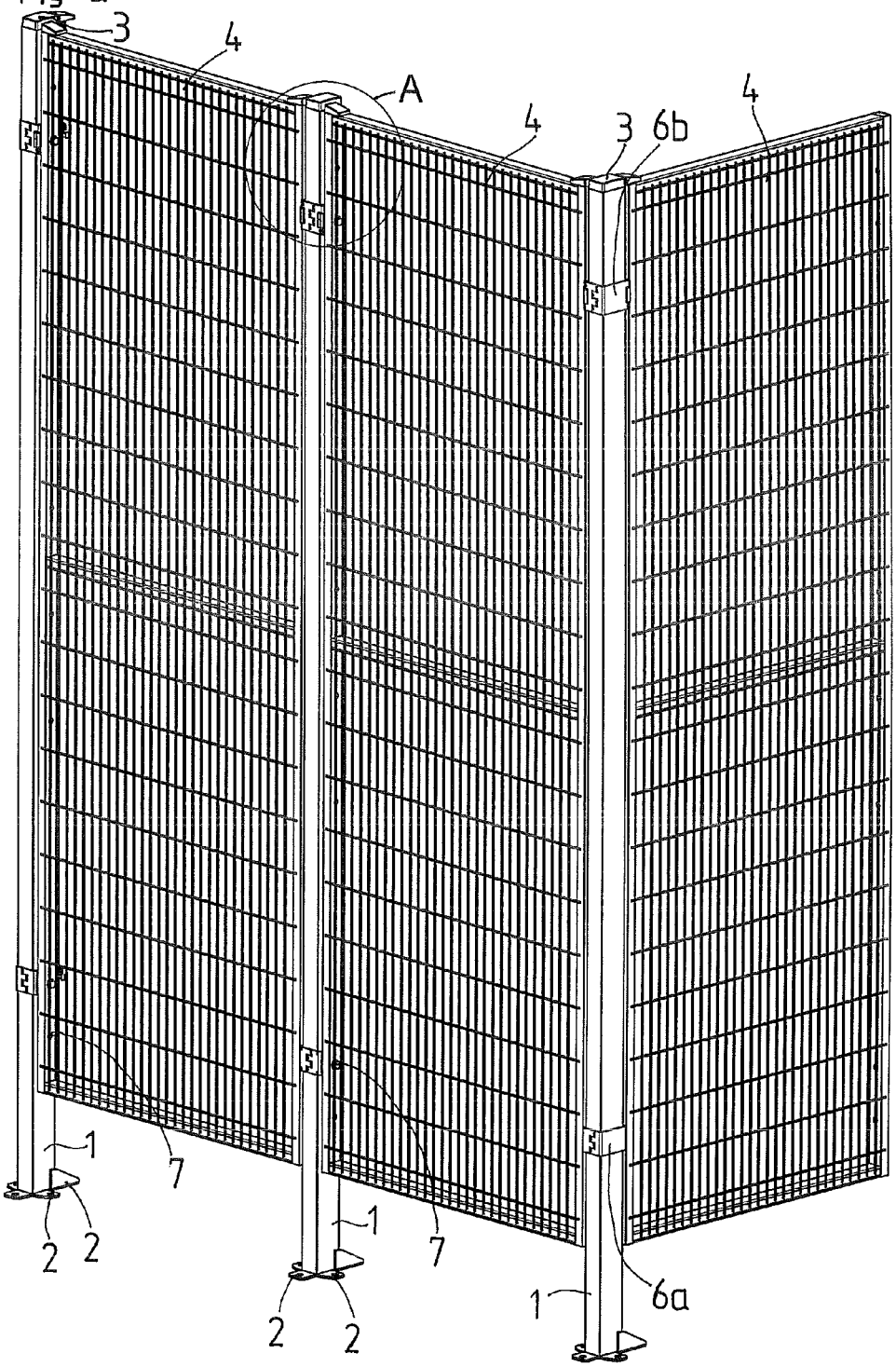
FIG. 1*a* shows an isometric view of a pair of wall elements with gratings mounted on an number of supporting poles.

In FIG. 1*a* it is shown a part of a system for shielding or machine safeguard. The shown system is typically seen to be used in an industrial room, even if numerous other applications are possible. The portion of the system which is shown in FIG. 1*a* comprises a number of upright poles 1. The poles 1 in the preferred embodiment are manufactured of metal, typical seen robust sheet metal, which has been given a square cross section. The poles 1 are thereafter given a surface treatment in an optional way, such as galvanization or lacquering. At the lower end of each pole 1 a anchor means 2 is provided for anchoring the pole 1 in a foundation, for example a floor. At the upper end of the pole 1 it is provided an end means 3, which encloses the upper end of the pole, this to prevent dirt from accumulating inside this. Between each pair of poles 1 there is provided a wall element 4, which in this case are grating sections, which have an outer frame 5 provided along its edges. The frame 5 gives stiffness to the grating, which in the preferred embodiment is manufactured of metal, and functions also as arrangement for the mountings, in the form of an outer part 8*b* of a lock means and a bolt 9, which is demanded for the attachment of the wall elements 4 at the poles 1.

Even if FIG. 1*a* shows wall elements 4 with gratings it is of course possible to use other materials, for example transparent or colored plastics, which furthermore ma protect against splash and spread of particles.

Around each one of the poles 1 shown in FIG. 1*a* it is provided an upper and lower mounting in the form of a metal clamp 6. The clamp 6 encircles the pole and is positioned in an optional position along the pole, this since the pole 1 in the preferred embodiment has a substantial constant cross section. To position the clamp 6 in a fixed position it is only demanded that the clamp 6 is tightened by means of a tension means 12. Thus, no making of holes or other machining of the pole 1 is needed in the appropriate position. To achieve a maximal freedom of choice concerning the position of the clamp 6, there is provided a series of holes 7 in the same way on the frame 5 of the wall elements 4, such as the frame 5 may be provided with interacting means in these positions.

Figure 1B:
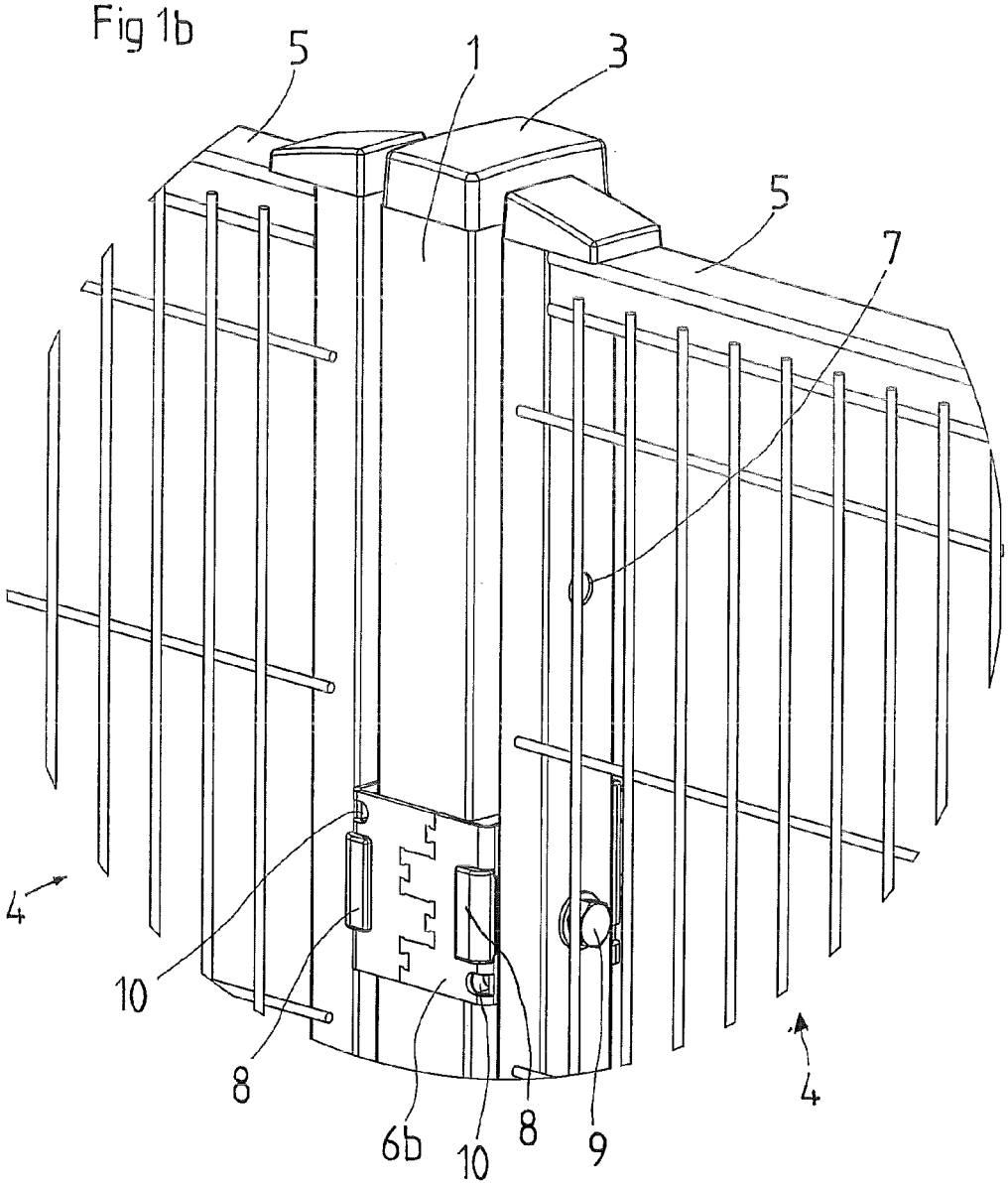
FIG. 1*b* shows an enlarged detail view of the area marked A in FIG. 1*a;*

In FIG. 1*b* it is shown an enlarged view of the area marked A in FIG. 1*a*. In the figure the upper clamp 6*b* is shown more clearly, which encircles the pole 1 and a lock means 8, which consists of or comprises an inner part 8*a* (which may include spring loaded parts as shown in FIGS. 4*b* and 5*b*) and an outer part 8*b*, and which connects the upper clamp 6*b* with the frame 5 of the wall element 4. The outer part 8*b* of the lock means may not be released without any particular influence from a particular influencing means, which in the shown embodiment is taken up in the hole 10, to unlock the lock means 8 and thereafter unfasten the wall element 4. In the shown embodiment it is possible to unlock the lock means from both sides of the clamp 6*b*, which means that it is possible to open the machine safeguard from both the inside and the outside, but it is possible to block the hole 10 from one side to receive an adaptation to the regulations and recommendations that prevails for the time being on a certain market.

Figure 1C:
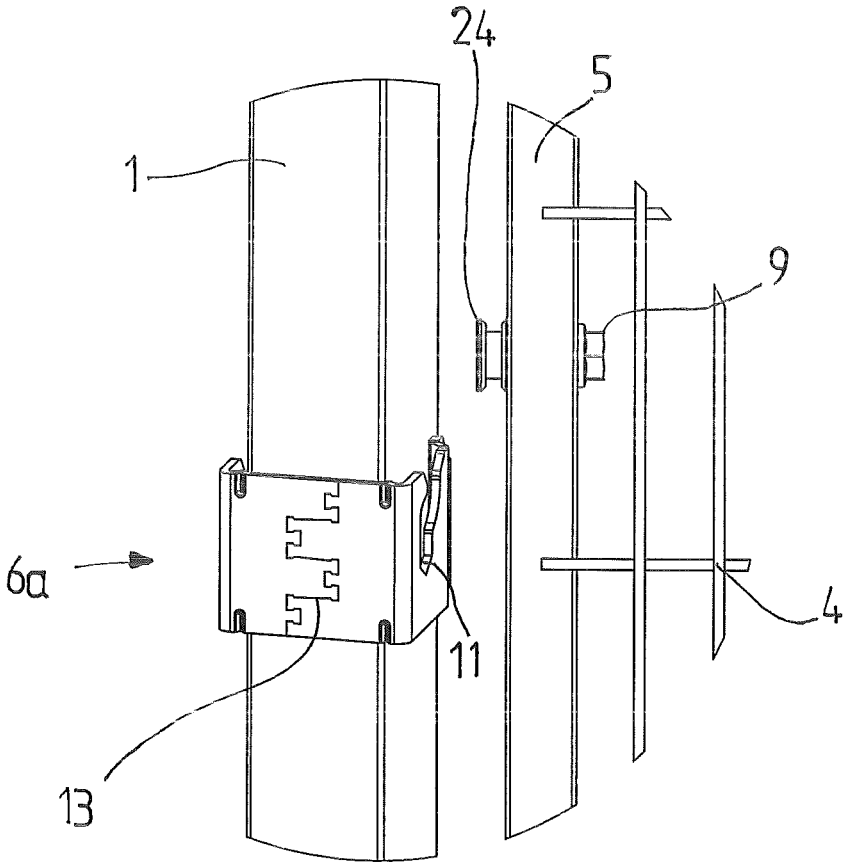
FIG. 1*c* shows an isometric detail view of a clamp provided on a pole.

FIG. 1*c* shows a close-up of an isometric view of the area around the lower clamp 6*a* on the pole 1, where the wall element 4 is released from the clamp 6*a*. A pin 24 is provided just opposite the bolt 9 on the frame 5 and is intended to be taken up by the slit 11. The pin 24 respective the bolt 9 are possible to arrange in any of the holes 7 (see FIG. 1*b*) in the frame 5.

Figure 2A:
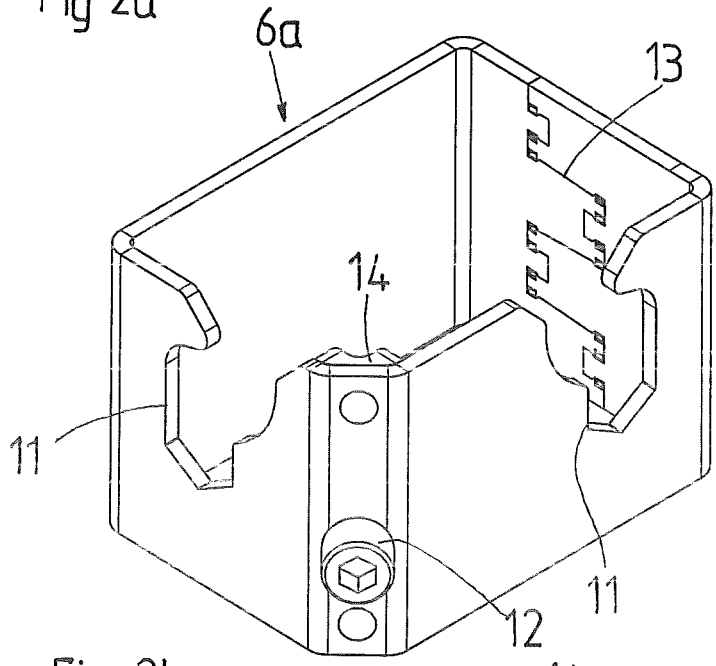
FIG. 2*a* shows an isometric view of a first embodiment of a clamp according to the invention.

In FIG. 2*a* there is shown an isometric view of an embodiment of the lower clamp 6*a*. The clamp 6*a* has a substantially rectangular cross section, which is dimensioned with a slightly larger cross section than the dimension of the outer cross section of the pole 1. The clamp 6*a* may therefore be entered from the end of the pole 1, and be drawn along the pole 1 until it has been arranged on an appropriate height for interaction with one of the lower bolts 9 and the pins 24 of the frame 5 of the wall element 4. On two sides of the clamp 6*a* there is provided slits 11, which are provided, for uptake of a protrusion in the form of the pin 24 which protrude sideways from the frame 5 of the wall element 4. The clamp 6*a* shown in FIG. 2*a* is intended to be used on a pole 1 which has the function of a corner element, such that the protrusions of wall elements 4 taken up in the slits 11 form an angle towards each other.

A tensioning means 12, in the form of a bolt, is provided in a corner area of the clamp 6*a*. At tensioning the tension means 12 its inner end will get into contact with an adjacent corner area on the pole 1, and the clamp 6*a* will be drawn towards the pole 1, in such a way that those sides of the clamp 6*a* which are provided opposite the tension means 12 will bear on the pole 1, whereas the two sides with slits 11 will be provided on a short distance from the pole 1. This has the advantage that the pins on the wall elements 4 taken up by the slits 11 may project a piece within the clamp 6*a*. When the tension means 12 is tightened the clamp is fixed both vertically and in the horizontal plane.

The slits 11, wherein the pins are introduced to support the wall elements 4, are curved to avoid unintentional lift of the pins out of the slits 11. This would otherwise be possible at an impact towards the surface of the wall element 4, where the wall element 4 slightly bends, and, as a consequence of this the pins in the slits 11 run the risk of moving upwards.

Along one of the sides of the clamp 6*a* there is provided a joint 13, which is shaped like a dove tail, but which has more profiling than a conventional dove tail joint. The joint 13 is strong, not least because the joint 13 has been given a shape with varying widths on the interacting protrusions in the joint 13. This gives an undercutting in relation to a thought dismounting direction in the plane. Those parts of the joint 13 which extend along the longitudinal direction of the clamp 6*a* are divided into shorter distances, which are sideways displaced in relation to each other. They are accordingly not placed along one single straight line, but are provided on at least four, substantially parallel lines. This gives a particular resistance to that the joint will break up by bend of this wall of the clamp 6*a*.

Other manufacturing methods, where the joint is absent or has another design, are also possible.

Figure 2B:
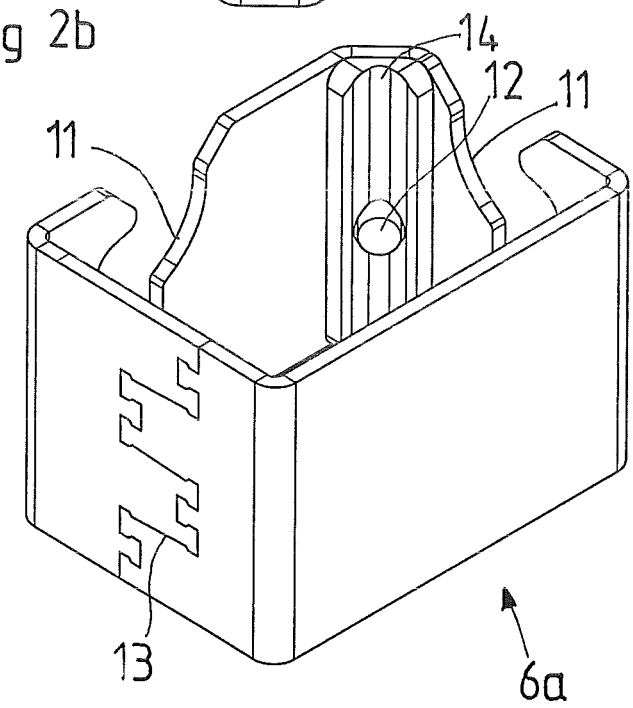
FIG. 2*b* shows an isometric view from the opposite direction of the clamp according to FIG. 2*a;*

In FIG. 2*b* the clamp 6*a* is shown in an isometric view seen from the opposite side compared to FIG. 2*a*. In this view the joint 13 is seen from its exterior side.

On the inside of the corner section where the tension means 12 is provided a lining 14 is provided, which preferably is manufactured of plastic, and which is attached on the inside of the clamp 6*a*, for example by jolting, gluing or melting. The lining 14 will permit that the clamp 6*a* simply may glide along the pole 1, while it is brought to its final position. The lining 14 will also work as guidance during the mounting, in such a way that the clamp will not end up in an askew position and get stuck.

Figure 3:
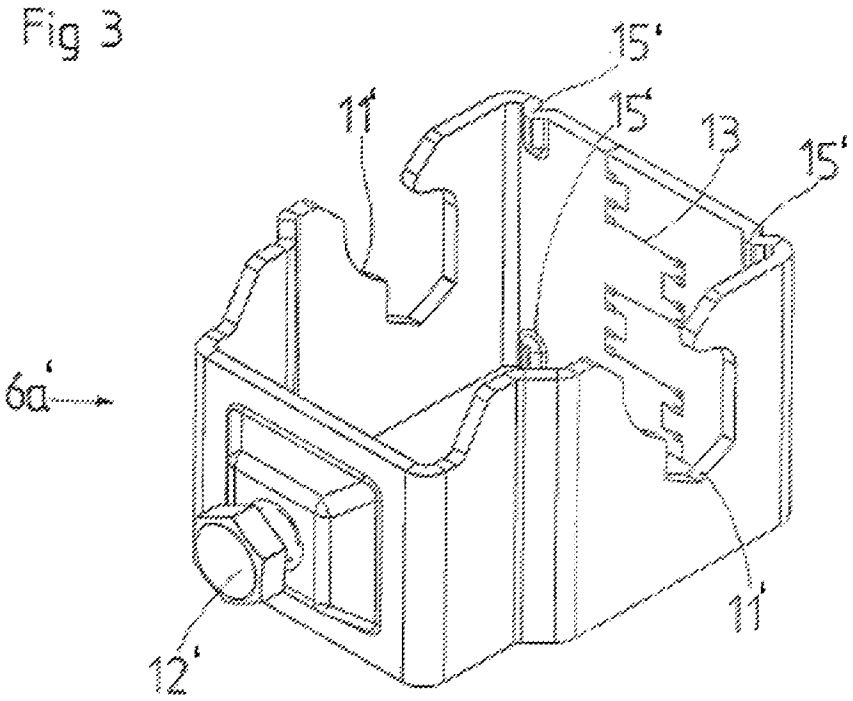
FIG. 3 shows an isometric view of a second embodiment of a clamp according to the invention.

In FIG. 3 it is shown a second embodiment of the lower clamp 6*a*', where the slits 11' are provided just in front of each other on opposite sides of the clamp 6*a*'. The tensioning means 12' is placed on one side which extends between those sides wherein the slits 11' are provided To keep an area inside the slits 11' free for take up of an pin of the frame 5 of the wall element 4, there is provided interior beads 15', which work to position the clamp 6*a*' on the pole 1, such that a space on each side of the pole 1 within the side walls of the clamp 6*a*' remains free.

FIG. 4*a* shows the body 6*c* for an upper clamp 6*b* (FIG. 4*b*). Like the lower clamp 6*a* the upper clamp 6*b* is intended to encircle a pole 1, at an optional height, i.e. on an arbitrary position along the pole 1. Like the lower clamp 6*a* the upper clamp 6*b* has also a joint 13, which is designed in substantially the same way as described above. FIG. 4*a* also shows a hole 16, which is intended for a tension means, which functions as the tension means 12 of the lower clamp 6*a*. The hole 16 is threaded, such that the tension means 12 may be tightened for fixation of the clamp 6*b* on the pole 1. Like the lower clamp 6*a*, the upper clamp is also intended to interact with means on the frame 5 of the wall element 4, in this case the outer part 8*b* of the lock means 8. For this interaction there are provided recesses 17, wherein the lock means 8, or parts thereof may be taken up. In the preferred embodiment which is shown in FIG. 4*a* the recesses are provided at an angle to one another, which means that this clamp 6*b* is intended to be provided at a corner of the shielding, in a corresponding way as the lower clamp 6*a* shown in FIGS. 2*a* and 2*b*.

In FIG. 4*b* the upper clamp 6*b* is shown out of another angle than the body shown in FIG. 4*a*. To the body 6*c*, shown in FIG. 4*a*, there has been added parts 8*a* to the lock means 8 in the recesses 17, a tension means 12 and an inner lining 18, which partly takes up parts 8*a* of the lock means 8 and partly positions the clamp 6*b* around the pole 1 at entering thereon. The outer part 8*b* of the lock means 8 is intended to be provided in one of the holes 7 in the frame 5 on either side of the wall element 4 on the same level as the mounted upper clamp 6*b*, and when the outer part 8*b* is brought into contact with the inner parts 8*a*, which are mounted in the recess 17 of the clamp 6*b*, such that they will snap into engagement with each other. This engagement is not possible to unfasten without the aid of an influencing means 21 (FIGS. 6*a*-6*b*), which via the hole 10 acts for disengaging, which has been described above according to FIG. 1*b*. FIG. 4*b* shows also a catch 23, which in the preferred embodiment is provided, such that it shall be possible to choose if the hole 10 shall be blocked or not, which has been described above.

The outer part 8*b* is mountable in the frame 5 of the wall element 4 by means of a lateral projecting casing 19, which is insertable in an optional hole 7 in the frame 5. The outer part 8*b* of the lock means 8 is symmetrical in a horizontal plane, which means that it is reversible, to be suitable for both sides of the wall element 4 and interact with clamps 6*b* arranged on both sides.

FIG. 5*a* shows a second embodiment of the body 6*c*' of the upper clamp 6*b*' (FIG. 5*b*) made in metal. The figure shows the body 6*c*' from a perspective view, and it may be seen that the recesses 17' are placed just in front of each other, i.e. the completed upper clamp 6*b*' is in this variant intended to be provided on a pole 1 between wall elements 4, which will be on substantially the same plane.

In another view of the second embodiment of the upper clamp 6*b*', now in a completed state, is shown in FIG. 5*b*. At each side upon which the inner parts 8*a*' of the lock means 8 are provided the inner linings 18 are also provided. As been mentioned above according to FIG. 4*b*, the outer part 8*b* of the lock means 8 is also shown, which interacts with the inner parts 8*a*', to lock together the wall element 4 and the clamp 6*b*'.

Figure 6A:
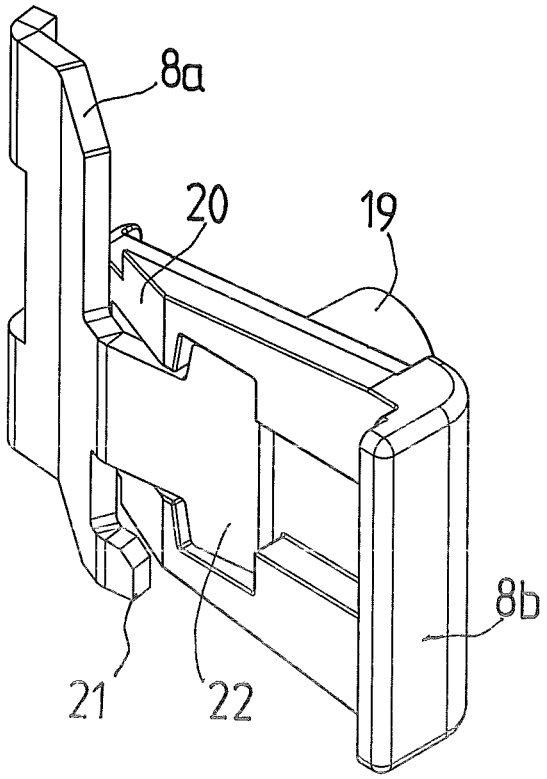
FIG. 6*a* shows an isometric view of two parts in an locked position comprised in the lock device.
Figure 6B:
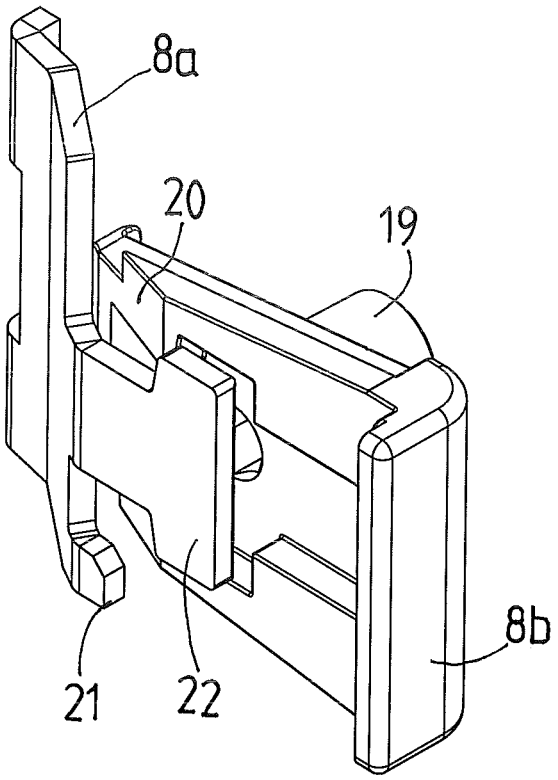
FIG. 6*b* shows a corresponding view according to FIG. 6*a*, wherein the parts are in an open position.

FIGS. 6*a* and 6*b* shows in detail the parts 8*a* and 8*b* of the lock means 8 in the locked respective the unlocked position. The parts are shown in an isometric view seen from the front at an angled view, but from another angle than the views shown in FIGS. 4*b* and 5*b*, and the actual clamp 6*b* is not shown in FIG. 6*a* and 6*b*.

FIG. 6*a* shows the lock, means in the locked position, where the outer part 8*b* has engaged with the inner part 8*a* of the lock means, by means of an inclined access surface 20 of the outer part 8*b* that has passed a engagement section 22 of the inner part 8*a*, which section has been taken up in an corresponding recess in the outer part 8*b*. In a locked position the engagement section 22 may not be released from the outer part 8*b*, this since an opposite angled inclined access surface is missing.

In FIG. 6*b* the inner part 8*a* has been angled to the side, by influence of a catch means 21 via the hole 10 on the clamp 6*b*, such that the engagement section 22 is released from the outer part 8*b*. In this position it is possible to open the lock means 8 and the wall element 4 may be removed.

Alternative Embodiments

In the shown embodiments there exists a certain type of lock means 8, whereupon the inner parts of the lock means are provided in the recesses 17 in the upper clamp 6*b*, whereas the lock means 8 has an outer part 8*b*, which interacts with the inner parts 8*a*. It is of course possible to adapt the design of the lock means 8 in a number of ways, concerning both the mechanical components in the lock means 8 and their interaction with each other to partly lock and partly release the wall element 4, which is held in place in its position by means of the lock means 8. Another way to modify the lock means 8 is to place additional components in the outer part of the lock means. It is also possible to change over functions and components in the lock means 8, in such a way that the those parts that are arranged in the recesses 17 instead are provided in the outer part 8*b* of the lock means or ice versa, without excluding anything from the original scope of the invention.

At the lower clamp 6*a* it is also possible in a similar way to change over the placement of the slit 11 and the bolt or screw 9 received therein, such that the bolt 9 is provided on the clamp 6 and the slit in an mounting provided on the frame 5, alternatively directly on the frame 5.

At arrangement of the wall element in the way shown in FIG. 1*a* the placement of the upper and the lower clamps 6*a*, 6*b* are natural and self-evident. The wall element 4 need only to be lifted a short distance to be able to be brought into the slits 11 on the lower clamps 6*a*. When this is done a major part of the weight of the wall element will be supported by the lower clamps, and the wall element just need to be turned in place until the inner parts 8*a* of the lock means are brought into contact with the outer part 8*b*, and these are snapped together. Another thought is that the wall element 4 is divided into an upper and lower half, then additional clamps 6 may be necessary on the pole 1. This is an obvious example of the flexibility of the device according to the invention.

Additional embodiments and variants will evident in the claims described below.

The present application claims priority of Swedish Application SE 1100894-3, filed Dec. 5,2011, which is incorporated by reference.

The invention claimed is:

1. A device for shielding, comprising a rigid wall element, two upright, supporting poles, the wall element being attached between the two poles, wherein the wall element is arrangeable between the two poles in an unlocked position in which the wall element is supported at a support location by the poles below a center of gravity of the wall element, the wall element being movable about the support location into a locked position from the unlocked position, and at least one upper encircling mounting and at least one lower encircling mounting are provided on each pole for interaction with a frame of the wall element, the lower encircling mounting supporting, the wall element at the support location and the upper encircling mounting locking the wall element.

2. The device according to claim 1, wherein the wall element includes a protrusion and the lower mounting has a slit open towards an edge pan of the lower mounting, the protrusion on the wall clement being receivable in the slit for arranging the wall element in the unlocked position.

3. The device according to claim 2, wherein the slit is curved.

4. The device according to claim 1, wherein the wall element includes an open slit and the lower mounting has a protrusion which is receivable in the slit on the wall element for arranging the wall element in the unlocked position.

5. The device according to claim 4, wherein the slit is curved.

6. The device according to claim 1, wherein the upper mounting comprises recesses to receive at least part of a lock device provided on the wall element.

7. The device according to claim 6, wherein the upper mounting comprises part of the lock device including spring loaded parts, and wherein another part of the lock device is arranged on the wall element, the spring loaded parts interacting with the another part of the lock device so that the lock device is adapted to be in either of a locked position and an unlocked position.

8. The device according to claim 7, wherein the lock device is releasable from the locked position only through influence from a catch or influencing means provided on the lock device.

9. The device according to claim 6, wherein the lock device is releasable from the locked position only through influence from a catch or influencing means provided on the lock device.

10. The device according to claim 1, wherein each encircling mounting is mountable on a respective pole of the two poles with bolt extending toward a center of the pole.

11. The device according to claim 1, wherein the wall element comprises recesses to receive at least part of a lock device provided on the upper mounting.

12. The device according to claim 11, wherein the wall element comprises a part of the lock device including spring loaded parts, and wherein another part of the lock device is arranged on the upper mounting, the spring loaded parts interacting with the another part of the lock device so that the lock device is adapted to be in either of a locked position and an unlocked position.

13. The device according to claim 12, wherein the lock device is releasable from the locked position only through influence from a catch or influencing means provided on the lock device.

14. The device according to claim 11, wherein the lock device is releasable from the locked position only through influence from a catch or influencing means provided on the lock device.

* * * * *